US007029532B2

(12) United States Patent
Kurkinen et al.

(10) Patent No.: US 7,029,532 B2
(45) Date of Patent: Apr. 18, 2006

(54) COATING STATION

(75) Inventors: Leo Kurkinen, Helsinki (FI); Vilho Nissinen, Numminen (FI); Mika Vähäkuopus, Järvenpää (FI); Risto Väätänen, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/694,333

(22) Filed: Oct. 27, 2003

(65) Prior Publication Data

US 2004/0083952 A1 May 6, 2004

(30) Foreign Application Priority Data

Oct. 29, 2002 (FI) ..... 20021923

(51) Int. Cl.
*B05B 13/02* (2006.01)
*B05C 5/00* (2006.01)

(52) U.S. Cl. ..... 118/325; 118/316; 118/419

(58) Field of Classification Search ..... 118/316, 118/325, 411, 419, 216; 52/220.7, 220.1
See application file for complete search history.

(56) References Cited

U.S. PATENT DOCUMENTS 2,772,653 A * 12/1956 Williamson et al. ..... 118/43
3,200,656 A * 8/1965 Baskett ..... 74/89.22
4,063,531 A 12/1977 Zitzow
4,398,665 A * 8/1983 Bryant et al. ..... 239/193
4,673,453 A * 6/1987 Georgii ..... 156/256
5,650,011 A * 7/1997 Yoshinaga ..... 118/413

FOREIGN PATENT DOCUMENTS

FI 108242 B 12/2001

* cited by examiner

*Primary Examiner*—Chris Fiorilla
*Assistant Examiner*—Yewebdar Tadesse
(74) *Attorney, Agent, or Firm*—Fildes & Outland, P.C.

(57) ABSTRACT

A coating station, which in intended for coating a web with a coating material, includes a load-bearing and cross-directional frame extending substantially across the entire width of the web. The coating station also includes applicator elements supported to the frame. The frame is arranged by at least one cross component formed out of sheet metal into a box-type structure, the cross component extending substantially across the entire width of the web. The cross component is attached to the end components by its end parts.

13 Claims, 5 Drawing Sheets

COATING STATION

FIELD OF THE INVENTION

This invention relates to a coating station, which is intended for coating the web produced with a forming machine with a selected coating material, comprising a load-bearing and cross-directional frame, which extends substantially across the entire width of the web, as well as applicator elements supported to the frame for applying the coating material to the surface of the web arranged to pass through the coating station.

BACKGROUND OF THE INVENTION

The most common forming machines are paper or board machines. Along with the increasing speeds of the paper and board machines, traditional roll-based coating methods and coating equipment have reached the limit of usability. Even at the present speeds coating materials tend to splash off the roll surface. In addition, vibration of elements used in applying and/or smoothing the coating material, such as doctor blades, is a problem. Coating of a thin web is also problematic mainly due to an insufficient strength. Furthermore, the rolls are large and the coating station therefore requires a lot of mounting space.

To eliminate the above mentioned and other problems, so-called non-contacting applicator elements have been developed for the coating stations. In the practical use, these developed coating stations use several nozzles for spraying the coating material onto the web surface. This is also referred to as atomizing of coating material. Embodiments of this type of coating station are set forth for example in the European patent No. 0826085. This patent teaches a method in which coating material, which is most commonly coating paste, is sprayed onto the supported web surface using nozzles connected to a supply pipe. The nozzles are additionally adapted in groups, which are located in a specific box for collecting the excess coating material spray. The patent also teaches that the coating unit must be provided with a sufficiently rigid frame. However, no more detailed description of the frame is given.

In traditional coating stations, like in the developed ones, the frame has heretofore customarily been formed of beam-like construction steels by welding. This kind of frame is massive and heavy, the coating station thus becoming large and unwieldy. At the same time, only reduced freedom remains for the positioning of the coating station. Besides the beam construction, the coating station-comprises various pipeworks, which further increase the total weight of the coating station. In addition, the previously mentioned European patent requires a specific box, which defines a large area. This increases the consumption of the coating material and complicates cleaning in particular when changing the coating material. Cleaning and maintenance of the nozzles located inside the box is also cumbersome.

SUMMARY OF THE INVENTION

The object of the invention is to provide a novel coating station with a simpler and lighter, yet more versatile design compared to the earlier designs, providing more freedom in its positioning in the forming machine.

More specifically, a coating station, which is intended for coating a web produced with a forming machine with a selected coating material, comprising a load-bearing and cross-directional frame, which extends substantially across the entire width of the web), as well as applicator elements supported to the frame for applying the coating material to the surface of the web arranged to pass through the coating station, is characterized in that the frame is arranged by at least one cross component formed into a box-type structure out of sheet metal, the cross component extending substantially across the entire width of the web, as well as by end components, to which the cross component is attached by its end parts.

The cross component may be removably adapted to attach to the end component with one or more screw connections or similar.

Arranged inside the cross component there may be at least one conduit extending substantially across the entire length of the cross component. And the conduit may be formed of profiled sheet metal blade, which is attached to that side of the cross component, which is adapted straight, which thus forms a part of the conduit.

The number of cross components may be 1–4 or 1–5.

The end component is advantageously made of sheet metal and is formed of two substantially similar sheet metal components, adapted at an interval from each other for forming a box-type structure. The thickness of the sheet metal is generally in the range of 0.5–5 mm. Preferably, the thickness of the sheet metal is 1–3 mm.

In an embodiment of the invention the cross component, end component and sheet metal blade are laser-cut and laser-welded.

The coating station may be characterized in that the applicator elements are non-contacting and comprise two nozzle units, with the therein included nozzles adapted to extend from inside the frame to the web side of the cross component for spraying the coating material onto the surface of the web.

The substantially similar nozzle units may be adapted to operate alternately, for which purpose each nozzle unit has been determined operating and maintenance positions, wherein the disabled nozzle unit is arranged in the maintenance position, which is located in the machine direction, further away from the web than the operating position.

The coating station may be characterized in that the coating station comprises two substantially similar frame structures that include applicator elements, the frame structures being set opposed to and at an interval from each other, the web being thus adapted to pass between the frame structures for coating simultaneously both surfaces of the web.

In the coating station according to the invention the frame is completely of a new kind. The frame is unexpectedly formed of special box-type components. This makes the total weight of the frame clearly smaller than is known heretofore. At the same time, the rigidity of the frame is, however, higher than heretofore and the vibration characteristics are better. In addition, arranged in connection with the box-type components there are for example constructions that have been separate heretofore. Thus the total weight of the coating station can be reduced while the number of components required for the construction decreases. The result is a simple, but rigid coating station frame, which also simplifies the use and maintenance of the coating station.

These and other features and advantages of the invention will be more fully understood from the following detailed description of the invention taken together with the accompanying drawings.

DETAILED DESCRIPTION OF THE INVENTION

Figure 1:
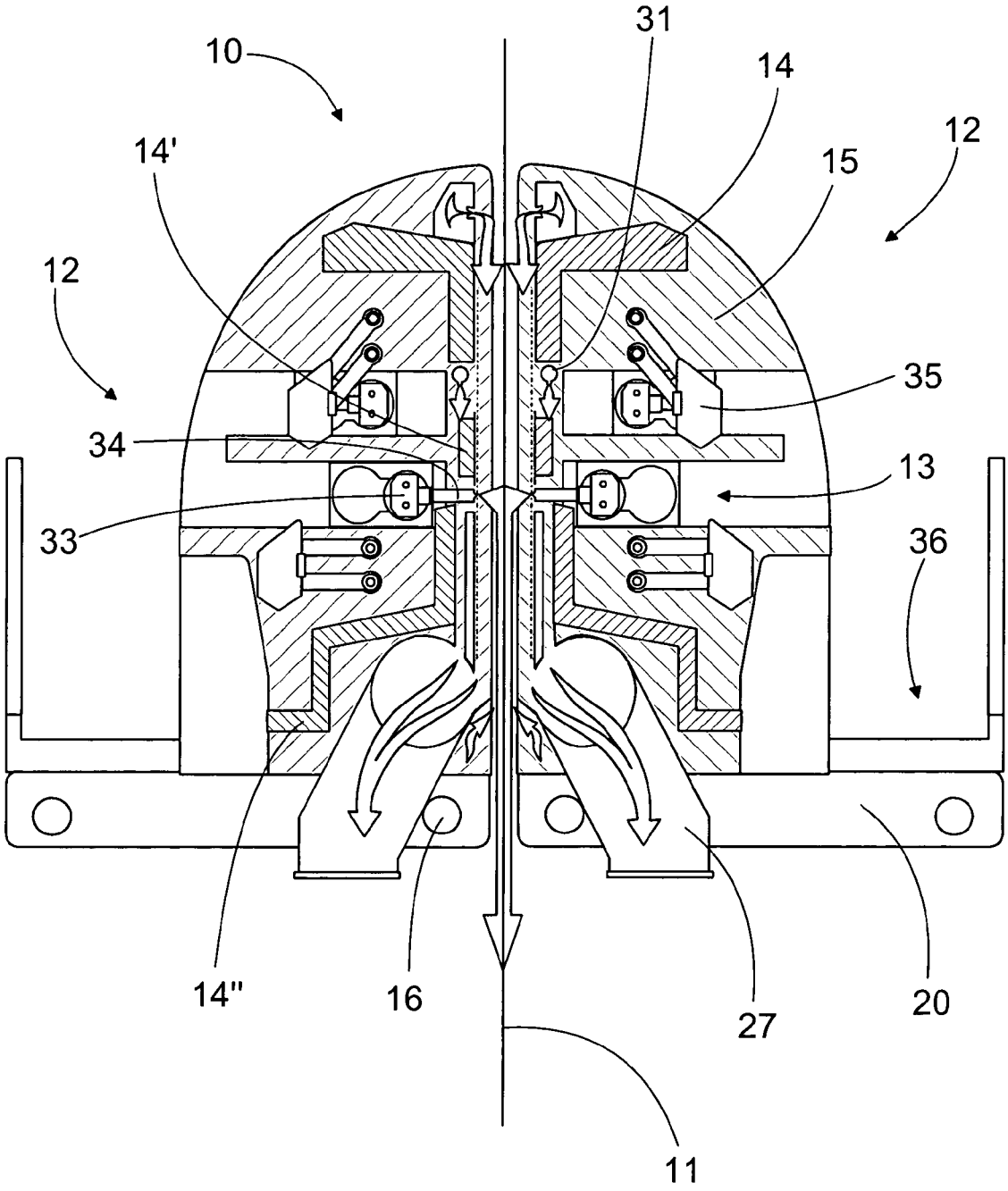
FIG. 1 shows a principal drawing of a sectional view of frame structures for the coating station according to the invention.

FIG. 1 shows a principal drawing of the coating station 10 according to the invention. Due to its design and operating principle the coating station is well suitable for a forming machine. The coating station is most commonly used for example in a paper or board machine for coating the produced web with a selected coating material. Coating is used to improve the quality of the final product. Generally a coating station includes a load-bearing and cross-directional frame. In the Figures the coating station and its components are shown separated from the rest of the former. In addition, the frame extends substantially across the entire web width. That is, the coating station allows coating of the web in one go throughout the entire width. In FIG. 1 the coating station 10 comprises non-contacting applicator elements 13 for spraying the coating material to the surface of the web 11 arranged to pass through the coating station. The applicator elements 13 are supported to the frame 12 and they can be different also as to their operating principles, such as for example blade coaters. The design and operation of the applicator elements is discussed in greater detail later.

According to FIG. 1, the coating station preferably includes two substantially similar frame structures 12, which contain the applicator elements 13. Consequently, the web 11 can be guided without support between the frame structures 12 set opposed to and at an interval from each other. Thus both of the surfaces of the web 11 are coated simultaneously. The use of two opposing frame structures also facilitates the separation of the coating station from the environment, which will be discussed in more detail later.

According to the invention, the frame of the coating station is arranged by at least one cross component, formed into a box-type structure out of sheet metal, and by end components. The cross component extends substantially across the entire web width, the end components being thus positioned outside the web edges. The cross component is additionally attached to the end component by its end parts, the end component being supported to the structural frame of the forming machine. Due to the box-type structure the frame and thus the whole coating station become remarkably light and compact. In addition, the rigidity of the box-type structure is good and the deflection caused by its own weight is reduced. Thus the positioning of the actual applicator elements is accurate and they can be positioned sufficiently near to the web.

Figure 2:
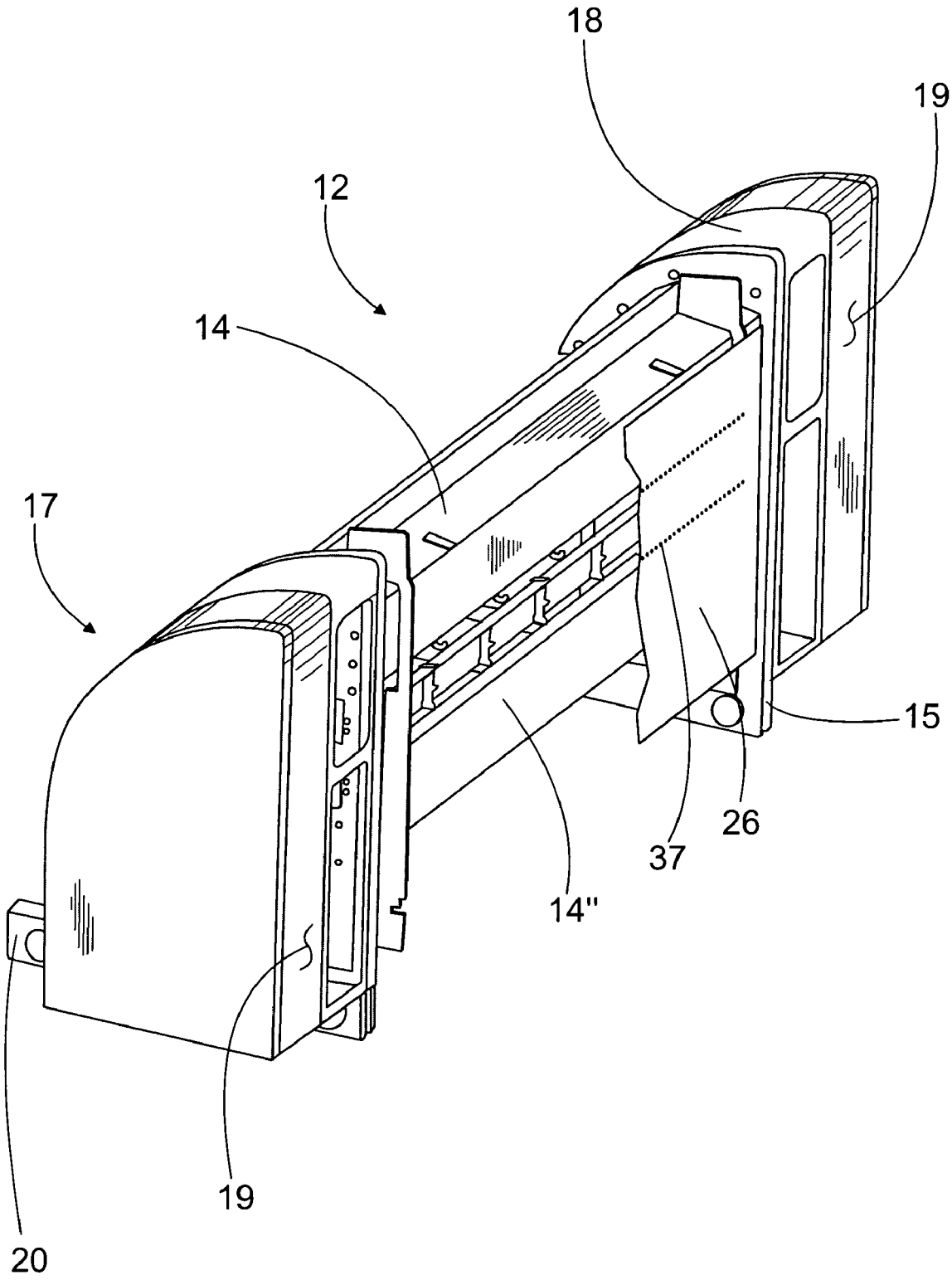
FIGS. 2–3 show an oblique front and rear view of the coating station frame according to the invention.
Figure 3:
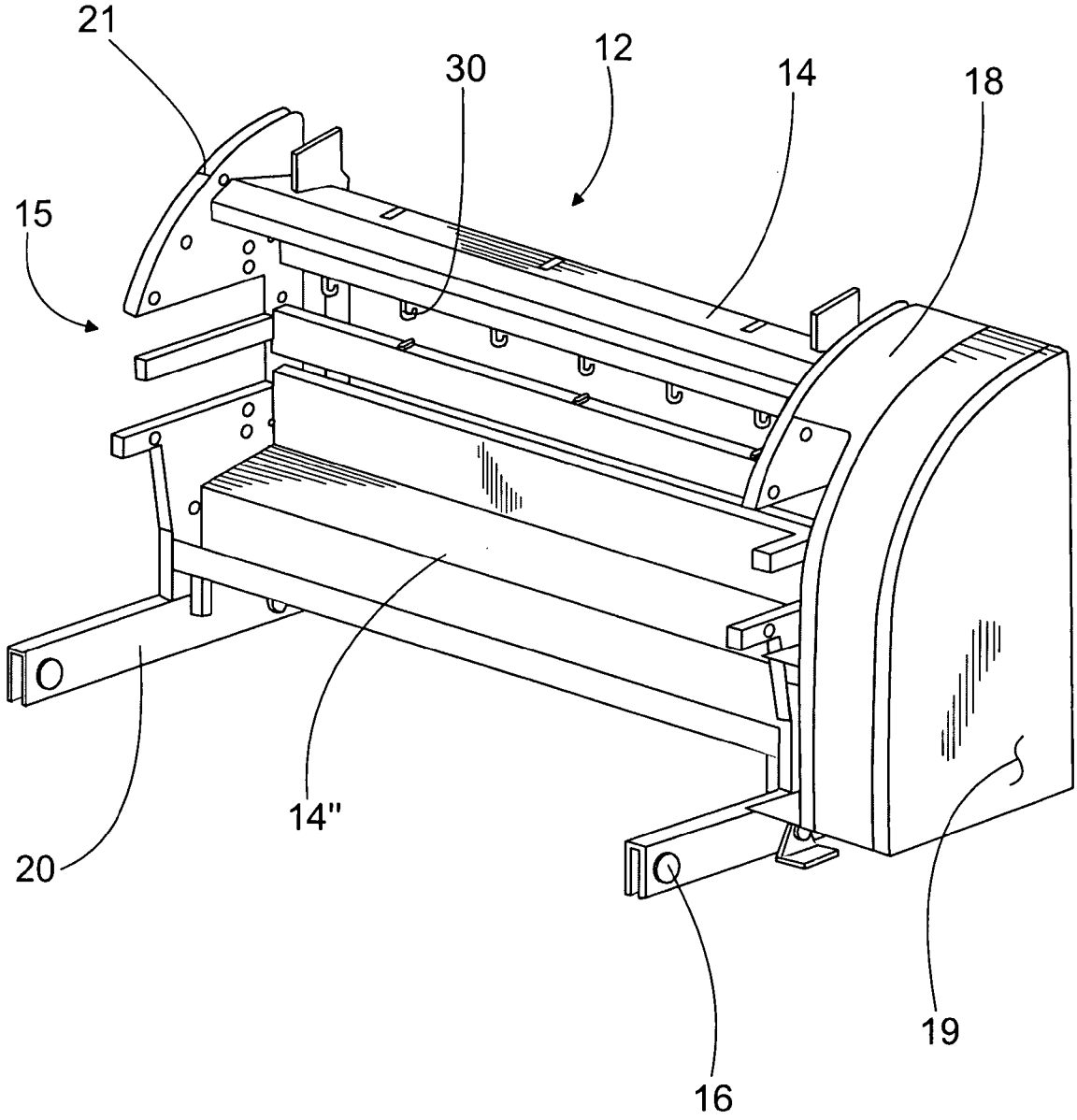

In the embodiments set forth the frame comprises three cross components 14, 14' and 14". The same reference numbers are used for functionally similar parts. Generally the number of cross components varies from one to four. By using several cross components it is easy to manufacture versatile frame structures with the individual cross component remaining sufficiently simple. This bottom portion of the end component 15 has additionally rollers 16, countering the rails (not shown) that are arranged in the structural frame of the forming machine. This makes it possible to move the coating station off the web for example for maintenance and cleaning. FIGS. 2 and 3 also show boxes 17 attached to the end component 15 for housing for example the required electronic components and other auxiliary devices. In FIG. 3 one of the boxes is removed. Spacious boxes 17 are formed of a frame 18 attached to the end component 15 and plates 19 attached thereto. The plates 19 are placed here only at the ends of the boxes 17, and thereby the openings in the frame 18 are clearly visible. The projecting parts 20 in the bottom portions of the end components 15 are additionally used to support a walkway 36, from which the coating station 10 can be monitored and serviced (FIG. 1).

Figure 4B:
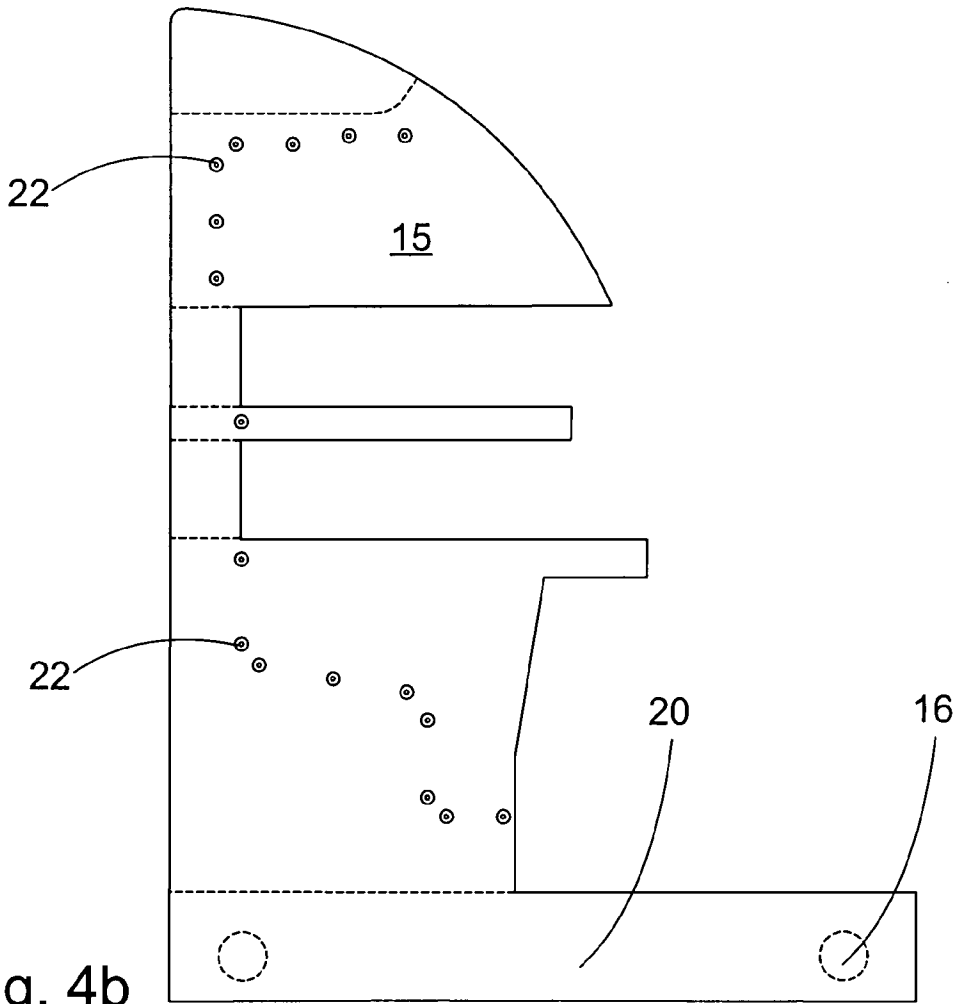
FIGS. 4*a*–*b* show an exploded view of the most central components of the frame.
Figure 4A:
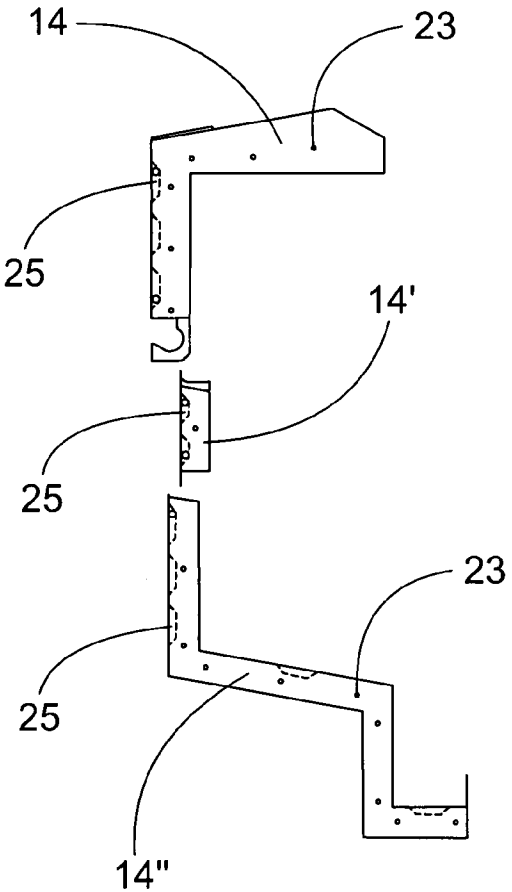

FIGS. 4*a* and 4*b* show an exploded view of the frame components. The end component 15 shown in FIG. 4*b* is also made of sheet metal and it is formed of two substantially similar sheet metal components, adapted at an interval from each other for forming a box-type structure. The separate sheet metal components connected by braces 21 appear well also from FIG. 3. This structure provides an end component that is rigid, yet light in weight. The manufacture and especially maintenance are additionally facilitated by the removability of the cross component. According to the invention the cross component is removably adapted to attach to the end component. One or more screw connections or similar are preferably used for the attachment. FIG. 4*b* illustrates the holes 22 arranged for the screws. Similarly, FIG. 4*a* illustrates the threaded holes 23 arranged at the ends of the cross components 14, 14' and 14". An accurate hole positioning thus prevents mounting errors. At the same time, the cross components can be replaced even one at a time if required.

Figure 5A:
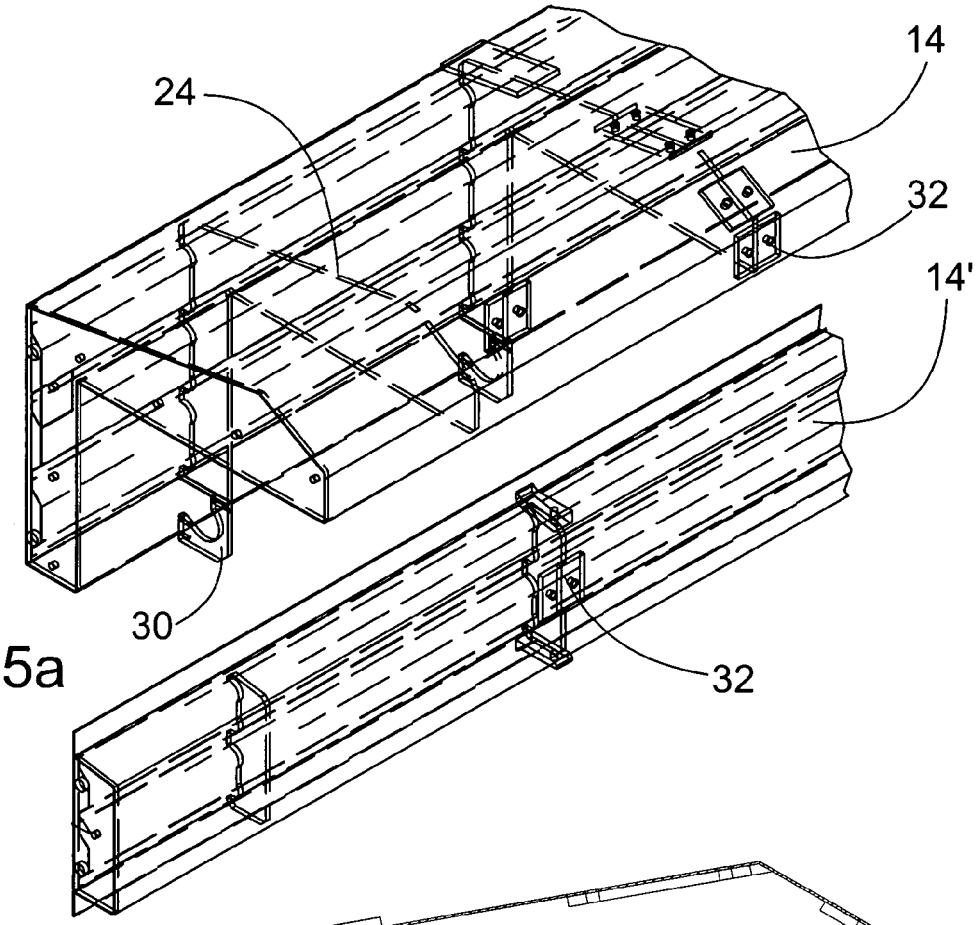
FIG. 5*a* shows a perspective wireframe model of the cross section of two parts of the frame component.
Figure 5B:
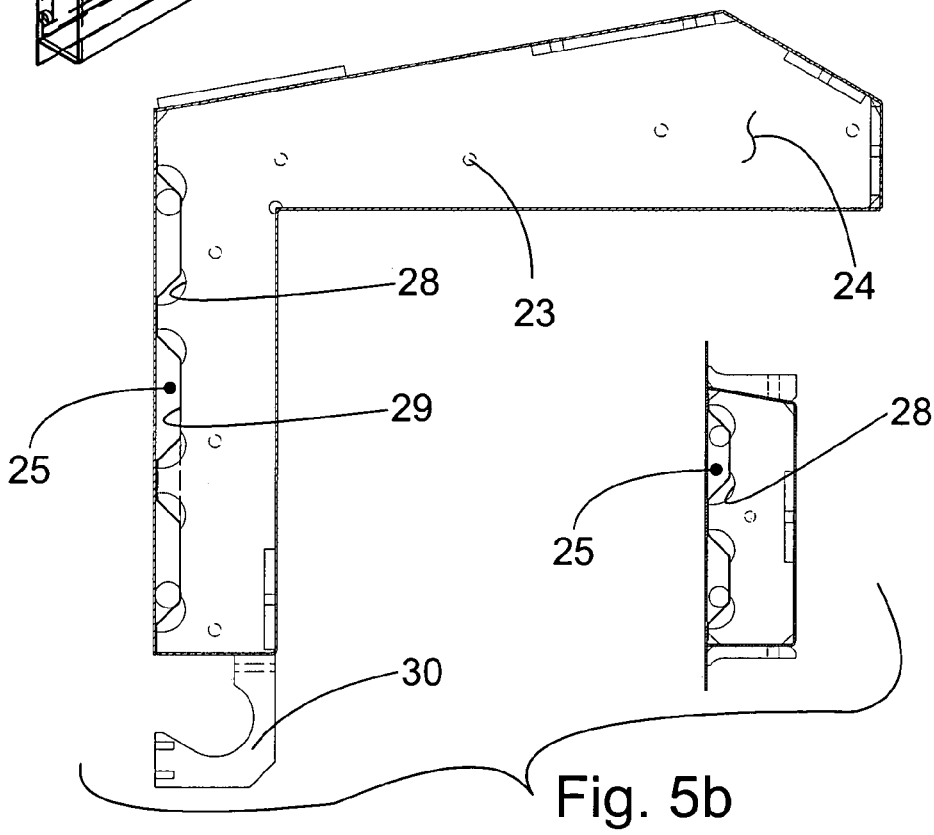
FIG. 5*b* is a side view of the components of FIG. 5*a*.

The design of the cross components 14, 14' and 14" is shown in more detail in FIGS. 5*a*–5*b*. The basic design of each cross component hence consists of a box made of sheet metal. The rigidity of the cross component is increased by the separation walls 24 arranged inside it at determined intervals. Unexpectedly, arranged inside the cross component there is also at least one conduit. The conduit extends substantially across the entire length of the cross component. In that case separate conduits are not needed. The conduit is used especially for recirculating the cooling water in the coating station. Moisture present in a warm environment condenses in the constructions of the coating station due to the cold cooling water. In the practical use, there is a front pan 26, which is partially seen in FIG. 2, between the cross components 14, 14' and 14" and the web 11. In FIG. 1 the front pan is illustrated with a dot-and-dash line. The front pan is substantially straight and covers the cross components. The cooling water is used to make the front pan sweat allowing thus a controlled recovery of the excess coating material spray. That is, moisture condensing on the front pan adsorbs the coating material spray. In addition, cleaning water can be led to the front pan from the top portion as shown in FIG. 1. The front pan is also easily removable, being thus rapidly replaceable during cleaning or coating material change. In the bottom portion of the front pan 26 there is additionally a vacuum collecting conduit 27 having additionally a seal air blow connected thereto (FIG. 1). In this way the coating station remains clean for a long time and the coating process is well isolated from the environment.

FIG. 5*b* is a sectional view of the cross components 14 and 14' of FIG. 1. The partition walls 24 additionally have suitable openings 28 for the conduits 25. According to the invention, the conduit 25 is formed of profiled sheet metal blade 29, which is unexpectedly attached to that side of the cross component, which is adapted to a straight shape. The cross component thus forms a part of the conduit. At the same time, a larger heat exchange surface is obtained compared to a round pipe. In addition, the wall thickness remains reduced, which further contributes to the heat transfer. The sheet metal blade for its part also increases the rigidity of the cross component increasing weight only slightly. The number of conduits varies depending mainly on the size of the cross component. Generally the number of conduits varies between one and five. For example, in the lowest cross component of FIG. 4*a* there are five conduits, of which two are located apart from the rest. This allows controlling the temperature of other coating station constructions as well.

Generally the sheet metal thickness varies from 0.5 to 5 mm, more advantageously from 1 to 3 mm. This helps to obtain easy machining, yet a light and rigid construction in particular when utilizing the box-type structure. Furthermore, according to the invention the cross component, end component and sheet metal blade are laser-cut and laser-welded. Machining works can thus be avoided and the dimensional accuracy of various components is good. Deformations are slight in laser welding and rustproof steel can be used as sheet material. Thus the assembly of the frame and the entire coating station is easy and the finished coating station is durable, yet light in weight. Besides sheet metal components, also thicker plate can be used, because laser cutting allows industrial cutting of plates with a thickness up to 12 mm. Other functions can also be easily connected to the cross component according to the invention. In the application example for instance, hook-like clamps 30 are formed in the bottom portion of the top-most cross component 14 for a cleaning pipe 31 (FIG. 1). In addition, adapted to these cross components 14 and 14' there are fixing points 32 for fixing protective pans for example. Separate brackets are thus unnecessary, which simplifies the manufacture and mounting.

FIG. 1 also shows the applicator elements 13, which here include two nozzle units 33. Each one has nozzles 34 arranged in a row, adapted to extend from inside the frame 12 to the web 11 side of the cross component. Thus the nozzles and their actuators are protected from the coating material spray. In addition, the nozzles open in connection with the front pan. For this purpose, on the front pan there are provided holes 37 for each nozzle (FIG. 1). Consequently, the coating event is well isolated from the environment and the applicator elements. FIG. 1 also illustrates the use of two substantially similar nozzle units 33 in the coating station. The nozzle units are adapted to operate alternately, for which purpose each nozzle unit has been determined operating and maintenance positions. Thus the disabled nozzle unit is arranged in the maintenance position, which is located in the machine direction, further away from the web than the operating position. FIG. 1 also shows the cleaning device 35, which is pivoted to the end component 15. The nozzle unit currently in the maintenance position can also be serviced from the walkway, even if the coating station is in use.

The coating station according to the invention is suitable for various positions and for coating different types of webs. The coating station is versatile and easy to use and service. In particular, the frame of the coating station is rigid, yet light in weight. In addition, the coating station is durable and compact in design including fewer components than heretofore. The coating event is also well isolated from the environment and the recovery of excess coating material is efficient reducing the loss of coating material.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A coating station, which is adapted for coating a web produced by a forming machine with a selected coating material, the coating station including a load-bearing and cross-directional frame, which extends substantially across the entire width of the web, as well as applicator elements supported by the frame for applying the coating material to the surface of the web arranged to pass through the coating station, characterized in that said frame includes opposing end components for attaching said frame to said forming machine, and at least one elongated cross component of a box-type structure formed of a plurality of sheet metal cells extending along a longitudinal direction between and connecting said end components, said as least one elongated cross component including at least one partition wall disposed perpendicularly to said longitudinal direction in said as least one elongated cross component.

2. A coating station according to claim 1, characterized in that the at least one cross elongated component is removably adapted to attach to the end components with one or more screw connections or similar.

3. A coating station according to claim 1, characterized in that arranged inside the at least one cross elongated component there is at least one conduit extending substantially across the entire length of the at least one cross component.

4. A coating station according to claim 3, characterized in that the at least one conduit is formed of a profiled sheet metal blade, which is attached to that side of the at least one cross elongated component, which is adapted straight, which thus forms a part of the conduit.

5. A coating station according to claim 1, characterized in that the number of cross components is 1–4.

6. A coating station according to claim 3, characterized in that the number of conduits is 1–5.

7. A coating station according to claim 1, characterized in that the end components are also made of sheet metal and are formed of two substantially similar sheet metal components, adapted at an interval from each other for forming a box-type structure.

8. A coating station according to claim 1, characterized in that the thickness of the sheet metal is 0.5–5 mm.

9. A coating station according to claim 8, characterized in that the thickness of the sheet metal is 1–3 mm.

10. A coating station according to claim 1, characterized in that the at least one cross component and the end components are laser-cut and laser-welded.

11. A coating station according to claim 1, characterized in that the applicator elements are non-contacting and comprise two nozzle units including nozzles, the therein included nozzles adapted to extend from inside the frame to the web side of the cross component for spraying the coating material onto the surface of the web.

12. A coating station according to claim 11, characterized in that the nozzle units are substantially similar and are adapted to operate alternately, for which purpose each nozzle unit has been determined operating and maintenance positions, wherein a disabled nozzle unit is arranged in the maintenance position, which is located in the machine direction, further away from the web than the operating position.

13. A coating station according to claim 1, characterized in that the coating station comprises two substantially similar frame structures that include applicator elements, the frame structures being set opposed to and at an interval from each other, the web being thus adapted to pass between the frame structures for coating simultaneously both surfaces of the web.

* * * * *